United States Patent [19]

Dyer

[11] Patent Number: 4,672,005

[45] Date of Patent: Jun. 9, 1987

[54] PROCESS FOR IMPROVING POLYMER SUBSTRATE PROPERTIES, AND MODIFIED POLYMERS PRODUCED THEREBY

[75] Inventor: Michael E. Dyer, Cleveland, Tenn.

[73] Assignee: Intera Corporation, Cleveland, Tenn.

[21] Appl. No.: 663,103

[22] Filed: Oct. 22, 1984

Related U.S. Application Data

[63] Continuation-in-part of Ser. No. 585,312, Mar. 1, 1984, abandoned.

[51] Int. Cl.[4] ..... B32B 27/08; B32B 27/34

[52] U.S. Cl. ..... 428/474.4; 427/393.4; 427/393.5; 428/475.8; 428/476.3; 428/483; 428/515; 428/516; 428/520

[58] Field of Search ..... 427/393.4, 393.5, 430.1, 427/DIG.3, 385.5; 428/474.4, 475.5, 475.8, 476.3, 500, 483, 516, 518, 520, 522, 265, 267, 272, 290; 8/115.6

[56] References Cited

U.S. PATENT DOCUMENTS

| | | | |
|---|---|---|---|
| 2,789,030 | 4/1957 | Fetscher . | |
| 2,909,449 | 10/1959 | Banigan | 427/393.5 |
| 3,065,041 | 11/1962 | Suen . | |
| 3,088,791 | 5/1963 | Cline et al. | 427/40 |
| 3,107,206 | 10/1963 | Cottet et al. | 427/40 |
| 3,115,418 | 12/1963 | Magat et al. | 427/40 |
| 3,377,249 | 4/1968 | Marco | 8/115.6 |
| 3,598,514 | 8/1971 | Sello et al. | 8/115.6 |
| 3,600,122 | 8/1971 | Coleman | 427/393.5 |
| 3,617,457 | 11/1971 | Sakurada et al. | 204/159.15 |
| 3,652,212 | 3/1972 | Machell | 427/393.4 |
| 3,926,551 | 12/1975 | Okada et al. | 8/115.6 |
| 3,958,932 | 5/1976 | Rowland et al. . | |
| 3,995,998 | 12/1976 | Rowland et al. | 8/115.6 |
| 4,043,753 | 8/1977 | Barbee | 8/115.5 |
| 4,068,256 | 12/1977 | Igeta et al. | 8/115.5 |
| 4,238,193 | 12/1980 | Kisaichi et al. | 8/115.5 |
| 4,242,408 | 12/1980 | Evani et al. | 428/476.3 |
| 4,309,560 | 1/1982 | Aoki et al. . | |
| 4,448,839 | 5/1984 | Morris | 427/393.4 |

FOREIGN PATENT DOCUMENTS

| | | | |
|---|---|---|---|
| 30197 | 9/1975 | Japan . | |
| 1444942 | 8/1976 | United Kingdom | 427/393.5 |

*Primary Examiner*—Sadie L. Childs

*Attorney, Agent, or Firm*—Oblon, Fisher, Spivak, McClelland & Maier

[57] ABSTRACT

A process for improving the hygroscopic and soil release properties of a polymer substrate is provided in which the substrate is contacted with a suitable aqueous mixture containing a water soluble vinyl monomer and a hydrophobic vinyl monomer at a temperature of between about 40° C. to 100° C., and initiating polymerization of the water-soluble monomer by a chemical or physical initiator to form a vinyl polymer evenly disposed on the substrate. The hygroscopic and soil release properties of the substrate are thereby improved. The mixture may be in the form of an emulsion wherein the hydrophobic vinyl monomer is emulsified by an appropriate emulsifying agent. The invention also pertains to the improved substrates prepared in accordance with the present process.

33 Claims, No Drawings

PROCESS FOR IMPROVING POLYMER SUBSTRATE PROPERTIES, AND MODIFIED POLYMERS PRODUCED THEREBY

CROSS-REFERENCE TO RELATED APPLICATION

This application is a continuation-in-part of co-pending patent application Ser. No. 585,312 filed Mar. 1, 1984, now abandoned. The disclosure of application Ser. No. 585,312 is incorporated herein by reference.

FIELD OF THE INVENTION

The present invention relates to the treatment of polymer substrates to improve the hygroscopic, antistatic, dye-receptive, soil release and/or other surface properties, as well as altering the hand of substrates in which the substrate is a fabric. More particularly, the invention relates to the treatment of polyester and polyolefin fibers to improve their surface properties.

BACKGROUND OF THE INVENTION

Synthetic polymer materials possess poor surface properties In particular, most fibers formed from polyester, polyolefin, polyamide and acrylic are not hygroscopic and have poor antistatic, and soil release properties. Many conventional fabrics formed from polyester and polypropylene have relatively poor hand properties. In particular, most polyester and polypropylene have a slick or synthetic fabric feel, as well as being deficient in terms of hygroscopic, antistatic, and soil release properties.

Attempts have been made by the prior art to polymerize a water soluble vinyl monomer onto a polymer substrate. This has proved to be particularly difficult with a polyester substrate or a polypropylene substrate.

The prior art has attempted three approaches to depositing a water soluble vinyl monomer onto a polymeric substrate.

The first approach appears to be by adhesion between the polymerized vinyl monomer and the polymeric substrate. Examples of this approach include U.S. Pat. Nos. 3,377,249 and 3,958,932.

The method of U.S. Pat. No. 3,377,249 employs an aminoplast textile resin to effect adhesion of a synthetic acid emulsion polymer to a polymeric substrate. In the method of U.S. Pat. No. 3,958,932 the vinyl polymer is affixed to the polymeric substrate by the use of elevated temperature curing.

A second approach involves entanglement of the polymer formed from the water soluble vinyl monomer into the substrate. In U.S. Pat. No. 3,926,551 water-insoluble polymers derived from acidic vinyl monomers are formed both on the surface and within polyester fibers. In U.S. Pat. No. 3,995,998 polymers derived from both acidic and non-acidic water soluble vinyl monomers are deposited on both the surface and within the fibers forming the polymer substrate. In U.S. Pat. No. 4,065,256 a composition comprising a liquid organic solvent, and a hydrophobic radical polymerization initiator is used to achieve graft polymerization onto both the surface and within a hydrophobic synthetic polymer substrate. In U.S. Pat. No. 4,238,193, an impregnated initiator is used to penetrate into the interior of a polymeric substrate fiber and to effect polymerization of a water soluble vinyl polymer both onto the surface of and within the substrate.

A third approach has been to chemically modify the polymeric substrate so as to receive the polymer from a water soluble vinyl polymerization. U.S. Pat. Nos. 3,088,791; 3,107,206; 3,115,418; and 3,617,457 each disclose the use of high energy radiation to modify a polymeric substrate. It is believed that the high energy radiation clears the bonds on the surface of a polymer to form free radicals. These free radicals participate in chemical reactions with the vinyl monomer. U.S. Pat. No. 3,088,791 irradiates a shaped organic polymer substrate at low temperatures. U.S. Pat. No. 3,107,206 irradiates a stem polymer that has been swollen with a non-polymerizable swelling agent. U.S. Pat. No. 3,115,418 irradiates a polymeric substrate in the presence of oxygen. U.S. Pat. No. 3,617,457 irradiates a polyester substrate and uses unique water soluble vinyl monomers.

U.S. Pat. No. 3,600,122 employs a spark discharge in a zone of free radical initiating gas to generate free radical sites on the surface of a polymeric substrate. This modified polymeric substrate is further reacted like any irradiated polymer.

U.S. Pat. No. 4,043,753 modifies a conventional polyester substrate by incorporating p-carboxycinnamic acid to replace a portion of a terephthalic acid of the polyester. The resultant polymeric substrate is a modified polyester polymer containing an unsaturated group that is susceptable to graft polymerization.

To the best of my knowledge, the prior art approaches have not yielded a polyester or polypropylene substrate which can be in the form of fibers making up a fabric that will withstand repeated launderings, such as 20 or more launderings in a conventional washing machine. Thus, it is an absolute essential for a satisfactory commercial product that it withstand repeated launderings.

Futhermore, the prior art approaches frequently suffer from undue expense, complex equipment requirements, and other processing shortcomings.

SUMMARY OF THE INVENTION

According to the present invention, a substrate formed of a polymer is contacted with an aqueous mixture containing a water soluble vinyl monomer and a hydrophobic vinyl monomer. Preferably, the aqueous mixture is maintained at a temperature within the range of about 40° C. to about 100° C. under agitation. Vinyl polymerization of the water soluble vinyl monomer is then initiated by a polymerization initiator. A vinyl polymer is formed on the substrate whereby the hygroscopic, antistatic, dyereceptive, soil release and other surface properties of the substrate are improved.

Preferably, the aqueous mixture is in the form of an emulsion containing the water soluble vinyl monomer and a cross-linking hydrophobic vinyl monomer emulsified by a suitable emulsifying agent, namely a surfactant. Thereafter, a polymerization initiator and catalyst may be added. It is possible for the same compound to function as both a polymerization initiator and as a catalyst. Polymerization and affixation of the polymer to the substrate is achieved, usually by means of elevating the temperature to a temperature in which such polymerization occurs, and/or the addition of an initiator.

I have found that the resultant polymeric substrate of my invention possesses desirable hygroscopic, soil release and/or other surface properties which withstand repeated launderings in a conventional washing machine, namely in excess of 20 cycles of home launderings. Although I have tested my invention only on substrates of polyester and polyolefin (specifically, polypropylene), the present invention contemplates the treatment of other polymer substrates, in particular polyamide and acrylic.

DETAILED DESCRIPTION OF THE INVENTION

By "mixture" as used herein is meant any aqueous solution, dispersion, suspension, colloidal solution, emulsion or other aqueous physical aggregation containing a water soluble vinyl monomer and a hydrophobic vinyl monomer. Although my work has been entirely on emulsions, the present invention contemplates not only forming an emulsion of the hydrophobic vinyl monomer, but also contemplates introducing the hydrophobic vinyl monomer into the aqueous medium by any other means, such as by dissolving the hydrophobic vinyl monomer in an appropriate solvent to aid formation of a physical dispersion.

By "substrate" as used herein is meant a polymer which is preferably in the form of fibers or fabrics, but may also be in the form of flakes, films, or of suitably shaped formed articles.

By "fiber" is meant to include monofilaments, multifilament threads, batts and staple fibers. By "fabrics" is meant to include woven fabrics, knitted fabrics, and nonwoven fabrics.

By "hydrophobic vinyl monomer" is meant a vinyl monomer which is not readily soluble in the surrounding aqueous medium under the conditions of the present invention, and which when employed in the present process, yields a substrate having durable improved surface properties.

By "vinyl polymer" as used herein is meant to include homopolymers resulting from the vinyl polymerization of the hygroscopic and/or water soluble vinyl monomers, and copolymers thereof.

By "vinyl polymerization" is meant polymerization in which a vinyl group in a monomer participates in the formation of a polymer.

Wherever the present disclosure refers to fiber surfaces or intimate contact of the monomer with fiber surfaces or like expressions, it will be understood that the individual fibers or filaments are being referred to, such that contact and attachment of the monomer and graft polymer is with the surfaces of individual filaments of a multifilament thread or bundle. I do not believe there is substantial penetration of the vinyl polymer into the substrates in the method and modified polymers of my invention.

Polyester is the generic name for a fiber manufactured either as a staple fiber or continuous filament in which the fiber-forming substance is any long chain synthetic polymer composed of at least 85% by weight of an ester of a dihydric alcohol and terephthalic acid. The most common polyester fibers available in the United States are made of polyethylene terephthalate, and are available for example under the trademarks "DACRON" of E. I. duPont de Nemours & Co. and "FORTREL" of ICI United States, Inc. and from Celanese Chemical Co. Polyester fibers are available as filament yarn, staple fibers and fiber tows and are often combined with other fibers, such as cotton and wool. For example, much clothing is made from yarns which are a blend of polyester and cotton staple fibers. Fabrics made from such polyester fibers and fiber combinations are commonly used for making many types of outerwear, including dresses, suits, shirts, etc. Such blends may be used as the substrates of my invention.

Polyesters form excellent fabrics and can be produced economically on a mass production basis, but polyesters suffer from many drawbacks. Polyesters lack the ability to significantly absorb water and are subject to static electricity problems. By treating polyester fibers according to the process of the present invention, a most useful fabric is formed which has very good water absorbing and soil-release properties which are retained after many washings.

Polyolefin is the name for a group of polymers derived from simple olefins. The preferred polyolefin for use in the present invention is polypropylene.

Polypropylene is a long chain synthetic polymer composed of at least 85 weight percent of polymerized propylene. Polypropylene has a low specific gravity which causes it to be bulkier for any given denier than polyester. As heretofore noted, polypropylene possesses a distinctive hand. Polypropylene can be blended with wool and other fibers, and is used as fabrics, cordage, sewing thread, upholstery strapping, wrapping for cotton bales, nursery shade cloths, disposable products such as diapers and sanitary napkins, medical products such as uniforms, sheets and drapes, filtration products such as tea bags and coffee filters, carpeting, laundry bags, synthetic turf, reinforcement material for civil engineering uses, backing fabrics, etc. Such blends may be used as the substrates of my invention.

Polyamides are high molecular weight polymers in which amide linkages (CONH) occur along the molecule chain. Preferred polyamides for use in the present invention are the synthetic linear condensation polyamides. Such polyamides include for example poly(hexamethylamine adipamide), which is prepared by the well known reaction of polycarboxylic acid such as adipic acid (or an amide-forming derivative thereof) with a polyamine such as hexamethylene diamine. The most common commercially available polyamides of this type in the United States are nylon 6,6 which is polyhexamethylene adipamide, and nylon 6 which is poly(hexamethylene caprolactam). These types of nylons are commonly extruded as filaments over a wide dimensional range, oriented by cold-drawing and knitted into many different forms of fabrics. Nylons are excellent fabrics and can be produced economically on a mass production basis, but nylon suffers from many drawbacks. Nylon lacks the ability to absorb water and is subject to static electricity problems. By treating nylon according to the process of the present invention, a most useful fabric may be formed which has very good water absorbing, antistatic, and said relese properties which are retained after many wasings.

Acrylic is the generic name for fibers in which the fiber-forming substance is any long chain synthetic polymer composed of at least 85% by weight of acrylonitrile units (—$CH_2CH(CN)$—). Such fibers are available in various types of staple fibers and tow, and are commerically available under the trademarks "ORLON" of E. I. duPont Nemours & Co. and "CRESLAN" of American Cyanamid Co., for example. Acrylic fibers for wearing apparel may be blended with other fibers, such as wool, or formed into yarns which are then knitted with other stronger synthetic fibers or filaments, such as nylon. Such blends may be used as substrates of my invention.

Most acrylics lack the ability to significantly absorb water and are subject to static. By treating polyacrylic fibers according to the process of the present invention, fabrics may be obtained which have excellent water-absorbing, anti-static and soil release properties which are retained after many washings.

Suitable non-limiting examples of water soluble vinyl monomers that may be used in this invention include N,N'-methylenebisacrylamide termed MBA, N,N'-(1,2-dihydroxyethylene)bisacrylamide, acrylamide, acrylic acid, 2-propyn-1-ol, crotonic acid, tetraethylene glycol diacrylate, vinylpyridine, methacrylic acid, methacrylamide, N-methylolacrylamide, N-methyl-N-vinyl formamide, N-vinyl pyrrolidone, 3-, 4-, or 5-methyl-N-vinyl pyrrolidone, maleic acid, vinyl oxyethylformamide, acrylonitrile, methacrylonitrile, methallylalcohol, acrylyl cyanide, styrene sulfonic acid, and water soluble salts of styrene sulfonic acid. The preferred water soluble vinyl monomers are N,N'-methylenebisacrylamide (MBA) and N,N'-(1,2-dihydroxyethylene)bisacrylamide. In some instances, two or more water soluble vinyl monomers may be copolymerized to yield the polymer used in this invention, such as maleic acid with MBA. Thus, some of the above monomers do not readily homopolymerize, but will copolymerize with other monomers, as is well known in the art.

The hydrophobic vinyl monomers are preferably cross-linking, namely have at least two reactive vinyl functional groups. All of the successful hydrophobic vinyl monomers which I have tested are cross-linking. However, it may be possible to use a non-cross-linking hydrophobic vinyl monomer under conditions which I have not investigated.

The hydrophobic monomers are also preferably emulsifiable. Suitable non-limiting examples of emulsifiable cross-linking hydrophobic vinyl monomers that may be utilized in this invention include ethylene glycol dimethacrylate, ethoxylated bisphenol A dimethacrylate, allyl acrylate, allyl methacrylate, 1,3-butylene glycol diacrylate, 1,3-butylene glycol dimethacrylate, 1,4-butanediol diacrylate, diallyl fumarate, diethylene glycol diacrylate, 2,2-dimethylpropane 1,3-diacrylate, 2,2-dimethylpropane 1,3-dimethacrylate, dipentaerythritol monohydroxypentaacrylate, ethoxylated bisphenol A diacrylate, 1,6-hexanediol diacrylate, 1,6-hexanediol dimethacrylate, pentaerythritol tetraacrylate, pentaerythritol triacrylate, pentaerythritol tetramethacrylate, trimethylolpropane triacrylate, trimethylolpropane trimethacrylate, and tripropylene glycol diacrylate. The preferred emulsifiable hydrophobic vinyl monomers are ethylene glycol dimethacrylate and ethoxylated bisphenol A dimethacrylate. A plurality of hydrophobic vinyl monomers may be copolymerized.

Prior to the polymerization, the hydrophobic vinyl monomers are contacted with the substrate. Preferably, a suitable emulsion of the hydrophobic vinyl monomers should be formed, with such emulsion contacting the substrate. By suitable emulsion as used herein is meant an emulsion in which no droplets are visible to the naked eye. Normally, in accordance with the present invention, the initial emulsion is milky in appearance. This milky appearance may be clarified somewhat or clarified completely as the hydrophobic vinyl monomer is withdrawn from the emulsion to the substrate.

I have found that in the absence of the contact of hydrophobic vinyl monomer with the substrate, the polymer derived from the water soluble vinyl monomer is relatively loosely affixed to the substrate and most of the improved properties attributable to this polymer are rapidly lost during washing.

I do not know if the hydrophobic vinyl monomer in the present process homopolymerizes on the substrate or copolymerizes with the water soluble vinyl monomer or whether both mechanisms occur simultaneously, or if there is a mechanism which I have not postulated. I have found that under the process conditions of the present invention a substantially durably affixed polymer having the surface properties of a polymer derived from the water soluble vinyl monomer is secured to the substrate.

I have determined that polymers prepared from the hydrophobic vinyl monomer alone do not have the desirable surface properties achieved by the polymers of the present invention. For this reason, I attribute the surface properties of the present invention to a polymer formed from the vinyl polymerization of the water-soluble monomer. I attribute the durable affixation of such a polymer to the substrate to the presence of the hydrophobic vinyl monomer.

For some hydrophobic vinyl monomers, it may not be necessary to first form an emulsion thereof prior to contacting the substrate. However, in the case where an emulsion is utilized, an appropriate concentration of emulsifying agent or surfactant should be used. If the concentration is too low, there will not be a suitable emulsion and there will not be even intimate contact between the hydrophobic monomer and the substrate. It is preferred to avoid the deposition of globs of visible particles of hydrophobic vinyl monomer.

Although not necessary to the operability of the present invention, there is preferably a period of time prior to the polymerization reaction when the hydrophophic monomer is dispersed adjacent to the substrate so that adequate contact between the hydrophophic monomer and the substrate is achieved. Preferably, an even deposition of the hydrophobic vinyl monomer on the substrate is secured. This period of time can vary greatly, and is normally between about 30 seconds to as much as about 30 minutes.

The basic structure of a surfactant contains two distinct elements, the hydrophobic and hydrophilic portions. Hydrocarbons containing chains of 8 to 20 carbon atoms offer suitable hydrophobes. Hydrophobes can include aliphatic compounds, that are either saturated or unsaturated and/or aromatic compounds. Hydrophobes can also contain oxygen or halogen atoms. Among commonly used hydrophobes are long straight chain alkyl groups, long branched chain alkyl groups, long chain alkyl benzenes, alkylnaphthalenes, rosin and lignin derivatives, high molecular weight propylene oxide polymers, long chain perfluoro alkyl groups, polysiloxane groups, and perfluorinated compounds. Common sources of hydrophobes would include tallow, coconut oil, vegetable oils, red oil, castor oil, olive oil, peanut oil, tall oil, cotton seed oil, safflower oil, mineral oil, alkyl benzene, diphenyl oxide, naphthalene formaldehyde condensates and lignin.

Among commonly used hydrophilic groups are the anionic, cationic, nonionic and amphoteric. The anionic groups would include carboxylic, sulfate, sulfonate, and phosphate esters. The cationic groups would include salts of primary amines, salts of secondary amines, salts of tertiary amines and quaternary ammonium compounds. The nonionic groups would include ethylene oxide adducts or other hydrophilic polymers that carry no electrical charge. The amphoteric groups would include surfactants that contain both acidic and basic hydrophilic groups that would function either as anionic or cationic depending on the pH of the solution.

A wide variety of surfactants can be used in the present invention. Examples include anionic surfactants such as alkyl sulfonates, alkyl sulfate, sulfated oil or fat, sulfated glycol ester, sulfated alkanolamide, sulfated alkylphenol polyglycol, sodium xylene sulfonate, sodium dibutyl naphthalene sulfonate, sodium dodecylbenzene sulfonate, sodium sulfonate of naphthalene formaldehyde condensate, sulfonated amide, monoalkyl phosphate salt, dialkyl phosphate salt, trialkyl phosphate, neutralized carboxylic acids (i.e. sodium stearate) and sulfated ethers.

Suitable surfactants also include amphoteric examples such as alkyl glycine, N-alkylbetaine, imidazoline glycine, sulfated polyglycol amine, and alkyl amine sulfonate.

Further suitable surfactants include cationic examples such as quaternary ammonium compounds, fatty amine salts, alkylamine polyoxyethanol glycols, fatty alkyl dimethyl benzyl ammonium chloride, lauryl pyridinium chloride, N-acyl,N'-hydroxyethyl ethylene diamine, N-alkyl, N'-hydroxyethyl imidazoline and amino amides.

Nonionic surfactants may also be used. Suitable examples include ethoxylated fatty alcohols, ethoxylated long branch chain alcohols, and ethoxylated alkyl aryl alcohols, and ethoxylated fatty amines. Other suitable nonionic surfactants include polyethylene glycol esters and polyethylene glycol amides.

The choice of surfactant and the amount of surfactant would be limited to those that do not significantly interfere with the polymerization reaction and interaction between the water soluble vinyl monomer, the hydrophobic monomer and the fiber. The preferred surfactants are the anionic and the nonionic. It has been found that some of the cationic (i.e. primary, secondary and tertiary amines) may interfere with the present invention under some reaction conditions. The determination of whether a given surfactant or the amount of a surfactant significantly interferes with such polymerization reaction and interaction may be done by routine preliminary testing within the skill of one of ordinary skill in the art.

The choice of the polymerization initiator would depend on the type of monomer, temperature of polymerization that was utilized, and other parameters.

All of my work has been with initiators which under the process conditions could polymerize both the water soluble vinyl monomer and the hydrophobic vinyl monomer in the absence of the substrate. Thus, I employed process conditions where in the absence of the substrate polymerization would be initiated in both the water soluble vinyl monomer and the hydrophobic vinyl monomer. The application of suitable initiators to both the water soluble vinyl monomers and the emulsifiable hydrophobic vinyl monomers is well-known in the art. The selection of suitable conditions for a particular initiator is within the skill of one having ordinary skill in the art and may be readily determined by simple testing within the skill of a person having ordinary skill in the art.

A physical impetus may be used to polymerize both the water soluble and the hydrophobic vinyl monomer. Examples of physical impetus include photochemical initiators, such as ultraviolet radiation, or ionizing radiation, such as gamma rays and fast electrons. By the term "initiator" I mean any chemical or physical impetus or combination thereof that will start and maintain a vinyl polymerization of the water soluble vinyl monomer.

Non-limiting examples of polymerization initiators that may be utilized in this invention include inorganic peroxides, e.g., hydrogen peroxide, barium peroxide, magnesium peroxide, etc., and various organic peroxy compounds illustrative examples of which are the dialkyl peroxides, e.g., diethyl peroxide, dipropyl peroxide, dilauryl peroxide, dioleyl peroxide, distearyl peroxide, di-(tert.-butyl) peroxide and di-(tert.-amyl) peroxide, such peroxides often being designated as ethyl, propyl, lauryl, oleyl, stearyl, tert. -butyl and tert.-amyl peroxides; the alkyl hydrogen peroxides, e.g. tert.-butyl hydrogen peroxide (tert.-butyl hydroperoxide), tert.-amyl hydrogen peroxide (tert.-amyl hydroperoxide), etc., symmetrical diacyl peroxides, such as acetyl peroxide, propionyl peroxide, lauroyl peroxide, stearoyl peroxide, malonyl peroxide, succinyl peroxide, phthaloyl peroxide, benzoyl peroxide, etc., fatty oil acid peroxides, e.g., coconut oil peroxides, etc., unsymmetrical or mixed diacyl peroxides, e.g., acetyl benzoyl peroxide, propionyl benzoyl peroxide, etc., terpene oxides, e.g., ascaridole, etc. , and salts of inorganic peracids, e.g., ammonium persulfate and potassium persulfate.

Initiators also include ceric ions, for example, in the form of ceric salts such as ceric nitrate, ceric sulfate, ceric ammonium nitrate, ceric ammonium sulfate, ceric ammonium pyrophosphate, ceric iodate, and the like.

Non-limiting examples of suitable acid initiators for use in the present invention include hydrochloric, phosphoric, sulfuric, nitric, acetic, formic, oxalic, tartaric, monochloroacetic, dichloroacetic, trichloroacetic and similar acids.

The polymerization should preferably occur in the presence of a catalyst. The acid initiators listed above, namely hydrochloric, phosphoric, sulfuric, nitric, acetic, formic, oxalic, tartaric, monochloroacetic, dichloroacetic, trichloroacetic and similar acids may function as both polymerization initiators and polymerization catalysts. When other forms of polymerization initiators are used, the presence of an additional catalyst may be desirable. Each of the aforementioned acids may function as a catalyst. In addition, other well-known polymerization catalysts include bases such as potassium hydroxide and sodium hydroxide, and other recognized catalysts including ferrous sulfate.

The time duration for the polymerization of the water soluble vinyl polymer should be between about 30 seconds and 30 minutes. Generally, the time duration is not critical, but the time should be sufficient for the polymerization to take place.

While the process of the present invention may be used at any of a number of stages during the usual processing of polymer fibers or fabrics, or other substrates, it has been found preferable to use the process before the dyeing of the fibers or before there is any treatment of the fibers which would result in encapsulation or coating of the fiber surface. Thus, it is common practice to encapsulate or "lock on" the dye or other fiber treatment chemicals, and such coating may often interfere with the present process. To the extent that there would still be improvement in surface properties, the improvement would be gradually washed off through many washings.

Therefore, it is preferable that the fibers be scoured and rinsed prior to carrying out the treatment process of the present invention in order to remove soil, finish oils, and other contaminants which may be present on the fibers. After the process of the present invention, it is preferable to drain the treating solution and rinse the fibers before dyeing, in order to remove acid and excess homopolymer, which may interfere with reaction of the dye with the dye sites.

Uniform dispersal and intimate contact of all chemicals is preferred. In the case of fibers this may be assisted by various forms of agitation or flow of the aqueous treating solution around and between the fiber surfaces. For example, in the case of the treatment of fibers in the form of fabric piece goods, agitation may be accomplished by the paddles in a conventional paddle tub. Alternatively, for fibers in the form of fabrics which are processed in the form of rolls on a beam, the aqueous treating solution may be circulated around and through the beam by conventional pressure means.

The time necessary for attaining uniform dispersal, intimate contact and attachment onto the substrate will vary with the particular method of contacting the substrate with the aqueous solution, and may range from one second to thirty minutes. Although it is possible that the aqueous solution could be contacted with the fibers by spraying, paddling, dipping or other means, it is most preferable to immerse the fibers in a bath formed by the aqueous solution. Using such immersion techniques, relatively short periods of time are necessary before polymerization may begin. For example, about 10 minutes is usually sufficient with adequate agitation or circulation of the aqueous solution.

The process can be controlled by restricting any one or more of the controlling factors of heat, time, initiator, catalyst, or monomer addition. Thus, by way of example and not by way of limitation, the monomers, catalysts, and substrate may be placed in an aqueous medimum with agitation, with the aqueous medium bein brought up to the appropriate temperature. The polymerization process can then be triggered by the addition of the initiator.

An alternative example would be to assemble the monomers, catalysts, initiators and substrate in an aqueous medium and maintain the same at a low temperature below the polymerization temperature. The polymerization process could then be triggered by raising the temperature.

This delaying of polymerization is sometimes necessary for complete dispersal of the components. It is seen from the foregoing that the sequence of steps is not critical, and that it may be varied with a different variable triggering the polymerization.

The substrate after being cleaned is immersed in water. The water may be at ambient temperature, or may be heated as to within the range of about 40° C. to 100° C.

The temperature is non-critical as long as a threshhold temperature sufficient to effect polymerization with the components at the concentration of the components is achieved. Generally, a temperature range between about 40° C. and 100° C. is suitable. I have found the temperature range within about 90° C. to 95° C. to be preferred. At a temperature within the range of about 90° C. to 95° C. lower concentrations of components can be used, particularly the preferred initiator, potassium persulfate. Some of the initiators, such as potassium persulfate under the conditions used, will not readily initiate a vinyl polymerization at a temperature as low as 40° C. However, other initiators will initiate vinyl polymerization at a temperature of as low as 40° C. and perhaps even lower. In most cases, the threshhold temperature is dependent upon the components, their concentration, and particularly the nature of the initiator.

In a preferred embodiment, the substrate is first immersed within the water. Thereafter, the hydrophobic vinyl monomer and the emulsifying agent are added to the water. A suitable weight percentage range for the hydrophobic vinyl monomer is normally between about 0.02 to 2.0 weight percent on weight of substrate and a suitable weight percentage range for the emusifying agent is any weight percentge range that achieves an emulsion that remains suitable throughout the process of the present invention, as "suitable" has been heretofore defined. The upper and lower limits of concentration for the hydrophobic vinyl monomer may be determined for any given combination of substrate, water soluble and hydrophobic vinyl monomers, initiators, catalysts and temperature by routine testing to determine durability of retention of improved surface properties after about 20 machine washings. Such tests for a given combination should indicate whether a particular desired improvement of surface properties for the substrate, such as improved wicking, hand, soil release, or antistatic properties, is retained by the substrate.

The system is agitated for a sufficient period of time for dispersal and contact of the components. A period of time of between about 30 seconds to 30 minutes may be used. Routine testing may be used to determine a satisfactory time period.

The system is preferably maintained under agitation throughout the process. Such agitation will result in better emulsification and dispersal of the hydrophobic vinyl monomer, so that a suitable emulsion of such monomer is obtained.

In the preferred process, the water soluble vinyl monomer is then added in a concentration between of preferably about 0.002 to 10 weight percent on weight of the mixture. The concentration of the water soluble vinyl monomer is normally not critical in terms of a desirable product, and may be varied. Upper and lower limits may be readily determined by routine testing for improved surface properties of the substrate.

The weight percentage concentration of the catalyst will depend upon the nature of the catalyst. This is readily determinable by simple tests within the skill of one having ordinary skill in the art. By way of example, suitable concentrations for hydrochloric acid are such that a pH between about two and four is achieved. At this concentration the hydrochloric acid serves primarily as a catalyst. At a pH of two or below, namely higher acid concentrations, hydrochloric acid may act as both a catalyst and a polymerization initiator. Such higher acid concentrations are known to the art.

The particular concentrations of the monomers, catalysts and the initiator in the treating solution will vary widely depending upon such factors as the nature of the particular monomers, catalyst and initiator, the time and temperature of the treatment, and the nature and form of the substrate being treated. While certain concentrations, catalysts, and initiators may be needed under a given set of treatment conditions, applicant cannot give general ranges which would apply to all monomers, catalysts and initiators under all conditions, but those of ordinary skill in the art will be able to optimize the concentrations by routine experimentation on the basis of the present disclosure.

Attaining the desired degree of treatment according to this invention depends on the strength of the initiator and the concentration of the monomers and catalyst. Thus, for example, a strong initiator, as for example a free radical initiator that forms relatively high concentrations of free radicals and/or a high weight concentration of initiator, could require a lower water soluble vinyl monomer concentration. Conversely, a weak initiator, namely one that is inherently weak and/or present in a low concentration, would require a higher monomer concentration. In the latter case, the treatment according to this invention can be controlled by draining the initiator containing solution from the fabric once the desired extent of polymerization has been achieved.

After polymerization begins, such polymerization being a function of the concentration and type of the catalyst, temperature, the vinyl monomers, substrate, initiator and type of equipment being used, the substrate is allowed to remain in the treating solution at a temperature long enough to assure that uniform graft polymerization ("substantial polymerization") has occurred, such time usually being between about 30 seconds and 30 minutes. The fibers can then be rinsed with water to neutralize the pH and remove excess homopolymers, if any.

The invention will now be described in greater detail by reference to the following specific, non-limiting examples:

EXAMPLES 1-9

A twenty gram scoured fabric sample made of one hundred denier, thirty-three filament, texturized polyester with a fabric density of 110.3 grams per square meter was immersed in 750 milliliters of 60° C. tap water in a 1,000 ml glass beaker that contained 0.1 gram of an emulsified monomer as found in Table I and seven drops of concentrated hydrochloric acid (pH of medium being about 3). The emulsified monomer was one part hydrophobic vinyl monomer as found in Table I and one part Holotex LO. Holotex LO is an American Hoechst Corporation product made of chlorinated benzene solvents, bisphenol A, and a proprietary emulsifier Dispersogne S. Dispersogne S is a polyoxyethylene aromatic surfactant. This solution was then heated to about 95° C. (plus or minus 3° C.) in about five minutes on a hot plate. While maintaining temperature 0.15 grams of N,N'-methlyene-bis-acrylamide (MBA) was stirred into solution and given three minutes to reach an equilibrium in the solution. Then 0.085 grams potassium persulfate was added and the monomers were given ten minutes to polymerize and react onto the fabric. The fabric was then rinsed in cold water and washed twenty cycles in a home laundry machine with a 69:1 bath ratio, 57° C. ten minute wash cycle, warm rinse cycle, and 2.0% on weight of goods of Tide home laundry detergent. Detergent was then rinsed out of the samples. A drop of tap water was allowed to fall one-half of an inch onto the fabric and the diameter of wetting or wicking was recorded.

TABLE I

| EX. No. | EMULSIFIED VINYL MONOMER | DIAMETER OF WETTING (mm) |
|---|---|---|
| 1. | Trimethylolpropane Trimethacrylate | 15 |
| 2. | Pentaerythritol Triacrylate | 14 |
| 3. | Pentaerythritol Tetramethacrylate | 13 |
| 4. | Ethoxylated Bisphenol A Diacrylate SR-349 | 11 |

TABLE I-continued

| EX. No. | EMULSIFIED VINYL MONOMER | DIAMETER OF WETTING (mm) |
|---|---|---|
| 5. | 1,6-Hexandiol Dimethacrylate | 9 |
| 6. | Ethoxylated Bisphenol A Dimethacrylate SR-348 | 8 |
| 7. | None | 0 |
| 8. | Phenoxyethyl Acrylate | 0 |
| 9. | Isodecyl Methacrylate | 0 |

Ethoxylated Bisphenol A Diacrylate SR-349 and Ethoxylated Bisphenol A Dimethylacrylate SR-348 are products of Sartomer Company, West Chester, PA, a subsidiary of Atlantic Richfield Company. SR-349 is described in the Sartomer technical bulletin TB-27 entitled "SR-349 Ethoxylated Bisphenol A Diacrylate", dated 5/80. SR-349 has the molecular formula $C_{25}H_{28}O_6$ and bears CAS Registry Number 24447-78-7. SR-348 is described in the Sartomer technical bulletin TB-26 entitled "SR-348 Ethoxylated Bisphenol A Dimethacrylate", dated 5/80. SR-348 has the molecular formula $C_{27}H_{32}O_6$ and bears CAS Registry Number 24448-20-2.

One can see from Examples 1 through 6 that all tested cross-linking hydrophobic vinyl monomers give substantial results, from Examples 8 and 9 that single vinyl monomers which are not cross-linking give bad results, and from Example 7 that the Holotex LO does not give substantial results. Any degree of wetting is evidence of improvement in hygroscopic properties.

EXAMPLE 10

Example 10 is the same procedure and components as Example 6 except that the 0.1 gram emulsified monomer consisted of one part by weight ethoxylated bisphenol A diacrylate, and one part phenoxyethylacrylate. Also, two parts of Holotex LO were used in place of the one part of Holotex LO in Example 6.

TABLE II

| EMULSIFIED VINYL MONOMER | DIAMETER OF WETTING (mm) |
|---|---|
| 10. Ethoxylated Bisphenol A Diacrylate and Phenoxyethyacrylate | 10 |

Example 10 exemplifies the use of a cross-linking hydrophobic vinyl monomer and a hydrophobic vinyl monomer which is not cross-linking together in the emulsion to give a substantial improvement in hygroscopic properties.

EXAMPLES 11 THROUGH 22

Examples 11 through 22 are the same procedure and components as Example 6 except that, as indicated, in Examples 11, 12, and 15-22 the Holotex LO has been replaced by other surfactants and in Examples 13, 14, 14(a) and 16-18 the polyester has been replaced by an equal weight of polypropylene fabric. Furthermore, under the column headed "EMULSIFIER" the weight in grams of the emulsifier used in the example is given within the parenthesis.

TABLE III

| FABRIC | EMUSIFIER | DIAMETER OF WETTING (mm) |
|---|---|---|

TABLE III-continued

| | | | |
|---|---|---|---|
| 11. | Polyester | (0.025 g) Sulfonated Fatty Acid Ester[1] | 7 |
| 12. | Polyester | (0.006 g) Disperesogne S | 15 |
| 13. | Polypropylene | (0.05 g) Holotex LO | 8 |
| 14. | Polypropylene - control | no emulsified monomer but (.1 g) Holotex LO | 0 |
| 14(a). | Polypropylene - control | no emulsified monomer and no Holotex LO | 0 |
| 15. | Polyester | (0.025 g) NP-10[2] | 10 |
| 16. | Polypropylene | (0.03 g) Phosphated NP-10[3] Reaction product of NP-10 & polyphosphoric acid in a 682:90 parts by weight ratio at 60° C. for 6 hours. | 6 |
| 17. | Polypropylene | (0.05 g) Varonic T215[4] and acetic acid. Reaction product of Varonic T215 & Acetic Acid 1:1 mole ratio. | 5 |
| 18. | Polypropylene | (0.04 g) Ester 1450[5] Reaction product of oleic acid & P.E.G. 400 at a 1:1.5 mole ratio. | 0 |
| 19. | Polyester | (0.025 g) Variquat E290[6] | 0 |
| 20. | Polyester | (0.02 g) Duomeen O[7] | 0 |
| 21. | Polyester | (0.05 g) Phosphated Varovic U215[8] Reaction product of Varovic U215 and polyphosphoric 1:2 mole ratio 65° C. for 6 hrs. | 4 |
| 22. | Polyester | (0.015 g) Variquat E290 | 8 |

It can be seen from these examples that different types of emulsifier are suitable on both polyester and polypropylene.

[1]The sulfonated fatty acid ester was Protowet XL sold by Proctor Chemical Company of Salisbury, North Carolina. Its specifications are given in a Technical Bulletin of that company. It has a physical form of an amber-colored clear oil, a pH of 5.8 to 6.2, with wetting speeds of 11.0 seconds at 0.2% Conc. and 25.0 seconds at 0.1% Conc. (AATCC Draves Wetting Test at 75° F.).

[2]NP-10 is a nonionic surfactant produced by Union Carbide Corporation of Old Ridgebury Road, Danbury, Conn. under the trademark "TERGITOL NP-10". It is nonylphenol polyethylene glycol ether having a CAS name of poly(oxy-1,2-ethanediyl), alpha-(4-nonylphenol)omega-hydroxy-.

[3]Phosphated NP-10 is the reaction product of polyphosphoric acid (115 weight percent), sometimes referred to as metaphosphoric acid, and NP-10 maintained in a weight ratio of acid to NP-10 of 90:682 under reaction conditions of 60° C. for six hours. The physical and chemical properties of the polyphosphoric acid are given in Stauffer Chemical Company's Product Safety Information Sheet entitled "Polyphosphoric Acid", Form 1044-000-00/73 of Stauffer Chemical Company Industrial Chemical Division, Westport, Conn.

[4]Varonic T215 is an ethoxylated fatty amine prepared from tallow and about 15 moles of ethylene oxide having a specific gravity at 25/25° C. of about 1.029 and a neutralization equivalent of about 935. Its properties are detailed in the Ethoxylated Fatty Amines Bulletin bearing printer's mark 9-508 published by Sherex Chemical Company, Inc. of Dublin, Ohio.

[5]Ester 1450 is the reaction product of oleic acid sold by Emery Industries, Inc., 4900 Este Avenue, Cincinnatti, Ohio 45232 under the trademark "Emersol 260" oleic acid and Carbowax Polyethylene Glycol 400" sold by Union Carbide Corporation, a polyethylene glycol having an average molecular weight within the range 380-420 and whose properties are given in Material Safety Data Sheet Form-43430A printed by Union Carbide Corporation on 5/76. The oleic acid and Carbowax-Polyethylene Glycol 400 are reacted in a mole ratio of 1 to 1.5 to form the corresponding esters. The negative results that were obtained are believed to be due to the physical properties of the surfactant which interfered with either the polymerization of the water soluble vinyl monomer or the coating of the fiber by the hydrophobic vinyl polymer. This was readily determined by 20 home laundry machine washings.

[6]Variquat E290 is palmityl trimethyl ammonium chloride having an average molecular weight of 320 produced by Sherex Chemical Company, Inc. and described in Sherex Bulletin entitled "Specialty Quats" as Variquat E290. The failure was due to an excess of emulsifier, see Example 22 where good results were obtained with this emulsifier. This emulsion appeared unduly thick and milky.

[7]Duomeen-O is N—oleyl-1,3-propanediamine produced by Armak Company, which is part of Akzona Inc. of P. O. Box 1805, Chicago, Illinois 60690 and described in its Bulletin 76-19. The failure in this experiment was probably due to the amine characteristics of this emulsifier. Amines are known to interact into the polymerization of water soluble vinyl monomers.

[8]Phosphated U215 is a reaction product of Varonic U215, an ethoxylated fatty amine having a cetyl-stearyl alkyl chain, a specific gravity of 1.025 and about 935 typical neutralization equivalent and is described in Sherex Chemical Company, Inc. Bulletin bearing the printer's mark 9-508 and polyphosphoric acid in a weight ratio of about 935 to 180 parts by weight reacted together at a temperature of 65° C. for 6 hours.

EXAMPLES 23 THROUGH 28

In Examples 23 through 28 the same procedure and components as Example 6 was used except that the ratio and amount of Holotex LO to ethoxylated bisphenol A dimethacrylate (EBAD) was varied to acheive different emulsions. In Example 23 there was a suitable emulsion with no visible droplets which produced an excellent product. In Examples 24 and 27 the very poor product was due to the emulsifying agent being present in large excess, so that it interfered with the contact and interreaction between the fiber and the hydrophobic vinyl monomer. In Examples 25 and 26 poor emulsions were formed with large visible droplets.

| | HOLOTEX LO (grams) | EBAD (grams) | DIAMETER WETTING (mm) |
|---|---|---|---|
| 23. | 0.117 | 0.05 | 13 |
| 24. | 0.117 | 0.0117 | 0 |
| 25. | 0.117 | 0.234 | 0 |
| 26. | 0.025 | 0.05 | 0 |
| 27. | 0.5 | 0.05 | 0 |
| 28. | 0.0 | 0.0 | 0 |

As indicated from the above data, it is absolutely essential that there be preliminary testing of any composition and procedure used in the present invention to make certain that under the specific physical and chemical conditions satisfactory polymerization of the water soluble vinyl monomer and its affixation to the substrate are obtained.

Polyester fabric was scoured, treated and dyed in accordance with Example 29.

EXAMPLE 29

Prescour

A ten pound (±5%) fabric sample made of one hundred denier, thirty-three filament, texturized polyester with a fabric density of about 110.3 grams per square meter was placed in a steam-heated Smith Drum rotary dye tub (10 pound rated fabric capacity) filled with 96 liters of warm (100° F.--120° F.) tap water. About 11 g of Tergitol NP-10 was added to the water and the drum was switched on for the balance of this Prescour step. Over the course of 5 minutes, the bath was heated to about 180° F., and maintained at 180° F. for about 10 minutes further. The drum was switched off, the tub was drained, and the fabric was rinsed according to the following standard rinsing procedure.

The drum was switched on and the tub was filled with warm (100° F.-120° F.) overflowing water. After 5 minutes, the drum was switched off and the tub was drained. The tub was then re-filled with warm tap water and the drum was again switched on. After 5 minutes, the drum was switched off and the tub was drained. The rinsing procedure was repeated until the rinse water was clear.

Pretreatment

The tub was filled with warm tap water and the drum was switched on. About 35 ml of industrial grade concentrated (33%) hydrochloric acid was added to the tub water to give a bath pH of about 3 according to universal pH paper. About 45 g of a solution containing by weight 35% ethoxylated bisphenol A dimethacrylate SR-348, 35% nonylphenol ethoxylate (NP-10) and 30% xylene, was added to the bath thereby forming an emulsion. The temperature was then increased to about 190° F. over about 5 minutes. The bath was maintained for an additional 5 minutes at this temperature. The drum was switched off and the tub was drained. The fabric was rinsed according to the standard rinse described in the Prescour step above.

Treatment

The tub was filled with warm tap water, and the drum was switched on. About 35 ml of industrial grade concentrated (33%) hydrochloric acid was added to the bath water to give a bath pH of about 3 according to universal pH paper. The temperature of the bath was then increased to about 140° F. over about 2 minutes. About 40 g of a water-soluble monomer mixture of the following composition by weight was added: 66% N,N'-methylenebisacrylamide, 10% glyoxal bisacrylamide and 24% sucrose. The temperature of the bath was then increased to 195° F. over about 5 minutes, and thereafter maintained at 195° F. for about 5 minutes. About twenty grams of potassium persulfate was then added, and the temperature was maintained at 195° F. for 10 minutes. The temperature was reduced to 160° F. by adding cold water, at which point the drum was switched off and the bath was drained.

Final Scour

The Prescour procedure was repeated as a post-scour.

I believe that polypropylene substrates may likewise be treated according to the present invention by following the procedure of Example 29.

In addition to wicking tests, as set forth in the above Examples, I have tested a number of fabrics treated in accordance with the present invention using AATCC Test Method 130 for stain release properties. I have determined that the modified fabrics of the present invention have superior stain release properties.

I have also determined that modified polymers of the present invention have superior hand properties.

While I have not tested the modified polymers of the present invention for superior antistatic properties, I am satisfied that it is reasonable based on my experience with other polymers, that the polymers of the present invention also possess improved antistatic properties.

The home washing machine utilized in the above examples was a "Kenmore" automatic, model 110.82070120, manufactured by Sears, Roebuck and Co. Thus, references to "cycles of laundering" or "cycles of laundering in a conventional home washing machine" in this specification or in the following claims pertains to laundering as performed in the aforesaid machine or a similar machine. Laundering was according to the following steps: (1) a 10 minute cycle of agitation in 55° C. tap water containing 2% "TIDE" home laundry detergent on weight of goods, (2) extraction of the wash water by spinning, (3) a warm rinse cycle with agitation, and (4) final water extraction (spin cycle).

I consider the improvement in hygroscopic properties of substrates treated according to the present invention to "persist" for 20 such washings if, after the twentieth washing, the treated substrate has retained at least some portion of its initial wetability as measured according to the procedure of the above examples.

The present invention may be embodied in other specific forms without departing from the spirit or essential attributes thereof and, accordingly, reference should be made to the appended claims, rather than to the foregoing specification, as indicating the scope of the invention.

I claim:

1. A process for improving the surface properties of a polymer substrate which comprises:

(a) contacting the substrate with an aqueous monomer mixture containing a water soluble vinyl monomer and a cross-linking hydrophobic vinyl monomer; and (b) subsequently initiating polymerization of said monomers by an initiator to form a vinyl polymer on the substrate whereby the surface properties of the substrate are improved.

2. A process according to claim 1 wherein the aqueous mixture is maintained at a temperature within the range of about 40° C. to about 100° C. under agitation.

3. A process according to claim 2 wherein the aqueous mixture is a suitable aqueous emulsion containing a water soluble vinyl monomer, a cross-linking hydrophobic vinyl monomer which is emulsifiable, and an emulsifying agent of a composition which does not adversely interfere with the process and which is present in an amount sufficient to maintain said suitable aqueous emulsion but not to adversely interfere with said process.

4. A process according to claim 3 wherein the monomer mixture contains a non-crosslinking hydrophobic vinyl monomer.

5. A process according to claim 4 wherein the vinyl polymer is evenly disposed on the substrate.

6. A process according to claim 4 wherein the improvement in the hygroscopic properties of the substrate persists for at least 20 cycles of laundering in a conventional home washing machine.

7. A process in accordance with claim 6 wherein step (a) comprises the steps of:

(i) immersing the substrate in water;

(ii) adding the cross-linking hydrophobic vinyl monomer and emulsifying agent to the water to form an aqueous emulsion of the cross-linking hydrophobic vinyl monomer;

(iii) agitating the system for a sufficient time for dispersal and contact of the components to occur; and (iv) adding water soluble vinyl monomer.

8. A process in accordance with claim 6 in which the initiation of polymerization is achieved by a chemical initiator.

9. A process in accordance with claim 6 in which the initiation of polymerization is achieved by a physical impetus which starts and maintains polymerization.

10. A process in accordance with claim 6 wherein the suitable aqueous emulsion in step (a) is maintained below the polymerization temperature and contains an initiator which is activated by raising the temperature above the polymerization temperature in step (b).

11. A process in accordance with claim 6 in which a catalyst is present to aid in initiating polymerization.

12. A process in accordance with claim 6 in which the temperature range during polymerization is between about 90° C. to 95° C.

13. A process in accordance with claim 6 in which the water soluble vinyl monomer is present in a concentration of between about 0.002 to 10 weight percent on weight of the aqueous emulsion.

14. A process in accordance with claim 6 in which the cross-linking hydrophobic vinyl monomer is present in the suitable aqueous emulsion in a concentration of between about 0.02 to 2.0 weight percent on weight of the substrate.

15. A process in accordance with claim 6 in which the suitable aqueous emulsion is in contact with the substrate for at least about 30 seconds to 30 minutes prior to initiating polymerization.

16. A process in accordance with claim 6 in which polymerization is achieved within about 30 seconds to 30 minutes after initiation in step (b).

17. A process in accordance with claim 6 in which the concentration of the water soluble vinyl monomer in the suitable aqueous emulsion is between about 0.002 to 10 weight percent on weight of the aqueous emulsion, the concentration of the cross-linking hydrophobic vinyl monomer is between about 0.02 to 2.0 weight precent on weight of the substrate, the suitable aqueous emulsion is in contact with the substrate for at least about 30 seconds to 30 minutes prior to initiating polymerization, and the polymerization is achieved within about 30 seconds to 30 minutes after initiation.

18. A process according to claim 2 wherein the substrate is polyester.

19. A process according to claim 3 wherein the substrate is polyester.

20. A process according to claim 6 wherein the substrate is polyester.

21. A process according to claim 2 wherein the substrate is a polyolefin.

22. A process according to claim 3 wherein the substrate is a polyolefin.

23. A process according to claim 6 wherein the substrate is a polyolefin.

24. A process according to claim 21, 22 or 23 wherein the polyolefin is polypropylene.

25. A process according to claim 6 wherein the substrate is a polyamide.

26. A process according to claim 25 wherein the polyamide is selected from the group consisting of nylon 6 and nylon 6,6.

27. A process according to claim 6 wherein the substrate is an acrylic.

28. The substrate having improved hygroscopic and soil release properties prepared in accordance with the process of claim 1.

29. The substrate having improved hygroscopic and soil release properties prepared in accordance with the process of claim 4.

30. The substrate having improved hygroscopic and soil release properties prepared in accordance with the process of claim 17.

31. The substrate having improved hygroscopic and soil release properties prepared in accordance with the process of claims 18, 19 or 20.

32. The substrate having improved hygroscopic and soil release properties prepared in accordance with the process of claim 24.

33. The substrate having improved hygroscopic and soil release properties prepared in accordance with the process of claims 25 or 27.

* * * * *

UNITED STATES PATENT AND TRADEMARK OFFICE

CERTIFICATE OF CORRECTION

PATENT NO. : 4,672,005

DATED : June 9, 1987

INVENTOR(S) : Michael E. Dyer

It is certified that error appears in the above-identified patent and that said Letters Patent is hereby corrected as shown below:

Column 1, line 24, after properties, insert --.--.

Column 2, lines 4 and 5, delete "disclose" and insert --discloses--.

Column 2, line 7, delete "clears" and insert --cleaves--.

Column 2, line 28, delete "susceptable" and insert --susceptible--.

Column 2, line 51, insert hyphen between the words "dye" and "receptive".

Column 4, line 54, delete "relese" and insert --release--.

Column 4, line 55, delete "wasings" and insert --washings--.

Column 5, line 28, delete "have" and insert --having--.

Column 7, line 53, the words "where in" should read as --wherein--, same line, after "substrate" insert --,--.

Column 9, line 36, delete "bein" and insert --being--.

Column 10, line 12, delete "percentge" and insert --percentage--.

Column 12, line 44, in Table IV, delete "Phenoxyethyacrylate" and insert --Phenoxyethylacrylate--.

Column 12, line 61, delete "parenthesis" and insert --parentheses--.

Column 14, line 17, delete "acheive" and insert --achieve--; line 61 is not properly aligned to the paragraph.

UNITED STATES PATENT AND TRADEMARK OFFICE

CERTIFICATE OF CORRECTION

PATENT NO. : 4,672,005

DATED : June 9, 1987

INVENTOR(S) : Michael E. Dyer

It is certified that error appears in the above-identified patent and that said Letters Patent is hereby corrected as shown below:

Column 15, line 63, delete "pertains" and insert --pertain--.

Column 16, line 7, delete "wetability" and insert --wettability--.

Column 16, line 40, delete "non-crosslinking" and insert --non-cross-linking--.

Column 17, line 28, delete "precent" and insert --percent--.

Column 12, line 68, in Table III, delete "EMUSIFIER" and insert --EMULSIFIER--.

Column 13, Table III, "Varovic" should read as --Varonic-- in both occurrences.

The words "water-soluble" and "soil-release" should be consistently hyphenated throughout the patent.

"Antistatic" should read as one word throughout the patent.

Signed and Sealed this

Thirty-first Day of May, 1988

*Attest:*

*Attesting Officer*

DONALD J. QUIGG

*Commissioner of Patents and Trademarks*